United States Patent [19]

Baker

[11] Patent Number: 4,583,616

[45] Date of Patent: Apr. 22, 1986

[54] PORTABLE FIRE ESCAPE

[75] Inventor: Ralph T. Baker, New Castle, Del.

[73] Assignee: Baker Safety Equipment, Inc., New Castle, Del.

[21] Appl. No.: 740,199

[22] Filed: May 31, 1985

[51] Int. Cl.[4] ..... A62B 1/20

[52] U.S. Cl. ..... 182/49; 182/70

[58] Field of Search ..... 182/70, 48, 49, 151, 182/76

[56] References Cited

U.S. PATENT DOCUMENTS

| | | | |
|---|---|---|---|
| 395,455 | 1/1889 | Reiss et al. | 182/70 |
| 495,955 | 4/1893 | Bouvier | 182/48 |
| 632,226 | 8/1899 | Menges | 182/70 |
| 790,613 | 5/1905 | Boyle | 182/49 |
| 3,580,358 | 5/1971 | Yamamoto | 182/48 |
| 4,079,811 | 3/1978 | Driskell | 182/70 |
| 4,099,596 | 7/1978 | Tracy | 182/48 |
| 4,240,520 | 12/1980 | La Grone | 182/47 |
| 4,398,621 | 8/1983 | Baker | 182/48 |

FOREIGN PATENT DOCUMENTS

| | | | |
|---|---|---|---|
| 1142060 | 2/1969 | United Kingdom | 182/70 |

*Primary Examiner*—Reinaldo P. Machado

*Attorney, Agent, or Firm*—Mortenson & Uebler

[57] ABSTRACT

A portable fire escape is provided comprising an entry support member and a mesh fire escape tube attached at one of its ends to the upper support member and at the other end to a lower exist-opening ring support member. The entry support member is affixed in the shape of a suitcase into which the mesh tube and lower exit opening support member can be placed for easy, portable transportation for use when travelling and staying in, for example, a hotel. Other components of the suitcase structure include easy opening side flaps and telescoping struts which permit rapid deployment of the fire escape chute and alignment in virtually any window configuration. The traveller who has this portable fire escape with him on his travels is assured of means of escape from his room in the event of a fire.

12 Claims, 10 Drawing Figures

PORTABLE FIRE ESCAPE

BACKGROUND OF THE INVENTION

This invention relates generally to fire escapes for an individual's use in evacuating a multiple story building.

Conventional fire escapes have disadvantages. They are generally finite in number, e.g. one or two per floor in a given building, if provided at all, and fixed in place so that, if smoke and flame approach a lower port of such fire escape, it is useless to persons on floors above that lower part.

As was apparent in the fires at the MGM Grand Hotel in 1980 and the Las Vegas Hilton hotel in 1981, present modern fire escapes are inadequate. In the MGM fire, at least 84 persons died. In the Hilton fire, 8 persons died. In both, helicopters having rescue seats suspended by cables from the aircraft were used to rescue persons from the roofs of the buildings and, in some instances, from balconies and windows. While these rescue efforts saved some lives, this method is very time consuming and terrifying to the inexperienced person being rescued.

More recently, 79 people died in a hospital fire in Bueno Aires, Argentina, because, as is typical in Argentina, the building was not equipped with fire escapes.

Many prior art devices are known which relate to chutes or tubes for use in escaping high-rise buildings in the event of a fire. Exemplary of such devices are those shown in U.S. Pat. Nos. 4,240,520 (1980) and 4,099,596 (1978).

U.S. Pat. No. 4,240,520 discloses a fire escape tunnel for use in exiting high-rise buildings. The tunnel includes an extendable, accordian-pleated tubing made of nylon or canvas fabric padded on its inner side, a ring at its upper end attachable to an escape opening of a building, a lower end of the tubing having a soft landing pad, and an exit doorway so a person sliding or being lowered down the tunnel can step out onto the ground at the exit.

U.S. Pat. No. 4,099,596 discloses a device including a normally-folded flexible tube with a landing pad at its lower end that unfolds to a vertical chute condition, the interior of the tube being slippery to provide against snagging and the like, the unfolded tube being formed with elastic restrictions at successive vertical levels that snub the descent of a person descending inside from free fall to an alleged safe speed.

U.S. Pat. No. 3,580,358 discloses a safety escape chute having a series of pliant tubular columns connected by resilient portions made of spiral mesh so that when a first escaper is in the chute his weight so deforms the spiral mesh resilient portions downwardly that a second escaper cannot pass therethrough and thus cannot collide with the first escaper at the bottom of the chute.

The fire escape tube utilized in this invention is basically as described and claimed in my prior U.S. Pat. No. 4,398,621, and that disclosure is incorporated herein by reference.

Portable tubular fire escapes are known such as that available from Palladium International Corporation, Tualatin, Oreg.

The present invention overcomes many disadvantages inherent in prior art devices.

SUMMARY OF THE INVENTION

Fire escape apparatus for exiting a building through an opening in the building is provided, the apparatus comprising a first, supporting entry ring member and a mesh tube attached at one of its ends to this first supporting entry member, the mesh tube being substantially longer than the building height from which escape is necessary, and a second, exit-opening support ring member attached to the other end of the mesh tube, the first supporting member being substantially a rectangular ring affixed within a generally rectangular frame casing having a top, a bottom and two sides, the casing being generally in the shape of a suitcase, the top having a handle affixed thereto, the top of the frame having at least two horizontal elongate recesses therein, in which horizontal recesses are housed extensible, elongate arm-like members, the sides of the frame each having at least one generally vertical elongate recess therein, in which vertical recesses are housed extensible, elongate leg-like members, the frame having front and rear closure flaps and closure means which enable closure of and encasement within the frame of the first support member, the attached mesh tube in a folded condition, and the second, exit-opening support ring member. When closed, the invention provides compact and portable fire escape means. When needed, a user places the apparatus adjacent an opening such as a window of a building from which escape is necessary, extends the arm-like and leg-like members, the former to their fully-extendible length and the latter to a desired length to accomodate the height of the window, places the rear of the frame adjacent the window and opens the rear flap, allowing it to extend outwardly from the window, and then opens the front flap and deploys the second support member and mesh tube outwardly and downwardly through the window, providing the user means for escaping the building through the mesh tube. The leg members are preferably telescoping elongate members having spring-loaded snap locks to lock them in place at a desired extension. A step means can be provided extending from one leg-like member to another leg-like member. A generally semi-circular spacer bar is preferably pivotally attached to each side of the frame and intertwined among the meshes of the mesh tube in such orientation that upon deployment of the tube the spacer bar is oriented at approximately 45° to the vertical, thereby providing an easily accessible entrance opening for the user. The openings in the mesh tube are large enough to permit finger insertion therein but small enough to prevent foot insertion therethrough, and preferably have a maximum dimension of about two inches. The tube has inside diameter sufficiently large so as not to restrict passage of a person escaping therethrough, whereby the escaping person can control his rate of descent by grasping the mesh anywhere within the tube. The tube preferably has an inside diameter in the range of about 3 feet to about 4 feet. An opaque shield can be used to encircle at least a part of the upper portion of the tube so as to prevent a person using the escape from seeing through the mesh upon entry into the escape. The mesh tube is preferably made of fire resistant nylon cord or fire resistant, elastic bungi cord. The top of the frame can have a groove extending from one side to the other to enable finger insertion therein to assist the user in entering the escape chute.

DETAILED DESCRIPTION OF THE INVENTION AND PREFERRED EMBODIMENTS WITH REFERENCE TO THE DRAWINGS

A portable fire escape is provided comprising an entry support member and a mesh fire escape tube attached at one of its ends to the upper support member and at the other end to a lower exit-opening ring support member. The entry support member is affixed in and is an integral part of a housing generally in the shape of a suitcase into which the mesh tube and lower exit-opening support member can be placed for easy, portable transportation for use when travelling and staying in, for example, a hotel. Other components of the suitcase structure include easy opening side flaps and telescoping struts which permit rapid deployment of the fire escape chute and alignment in virtually any window configuration. The traveller who has this portable fire escape with him on his travels is assured of means of escape from his room in the event of a fire.

Figure 1:
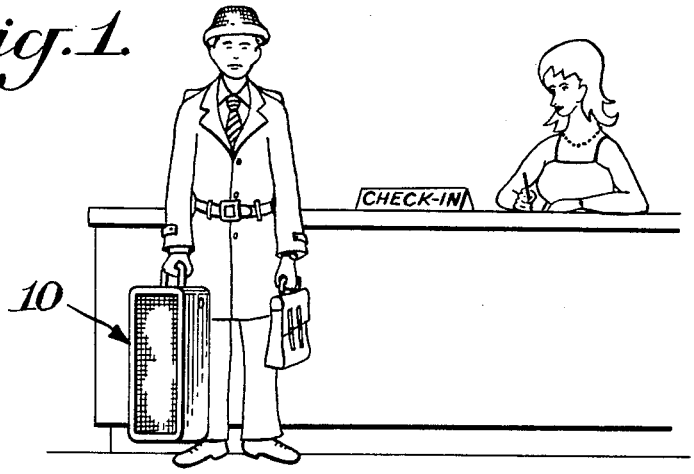
FIG. 1 is a pictorial view showing the environment in which the fire escape apparatus of the invention could be used.

A detailed description of the invention and preferred embodiments is best provided by reference to the drawings wherein FIG. 1 depicts the entire fire escape apparatus 10 according to the invention in its folded up, encased configuration, being carried by a person checking into a hotel.

Figure 3:
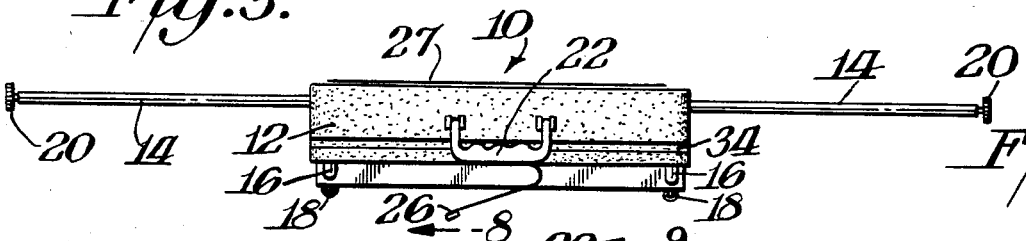
FIG. 3 is a top plan view of the fire escape apparatus as in FIG. 2.
Figure 4:
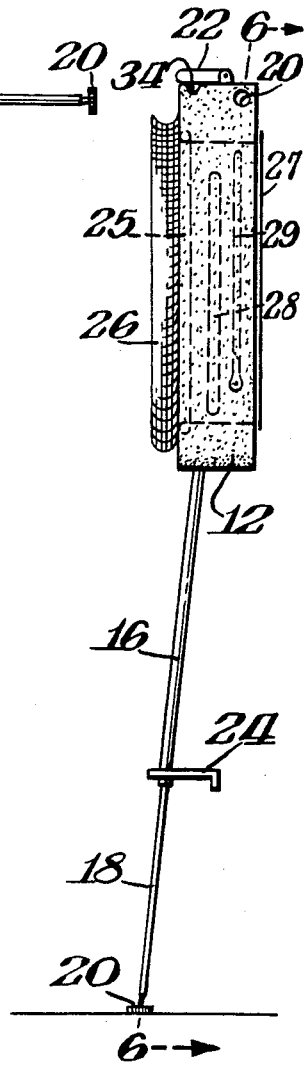
FIG. 4 is a side elevation of the fire escape apparatus as in FIG. 2.
Figure 2:
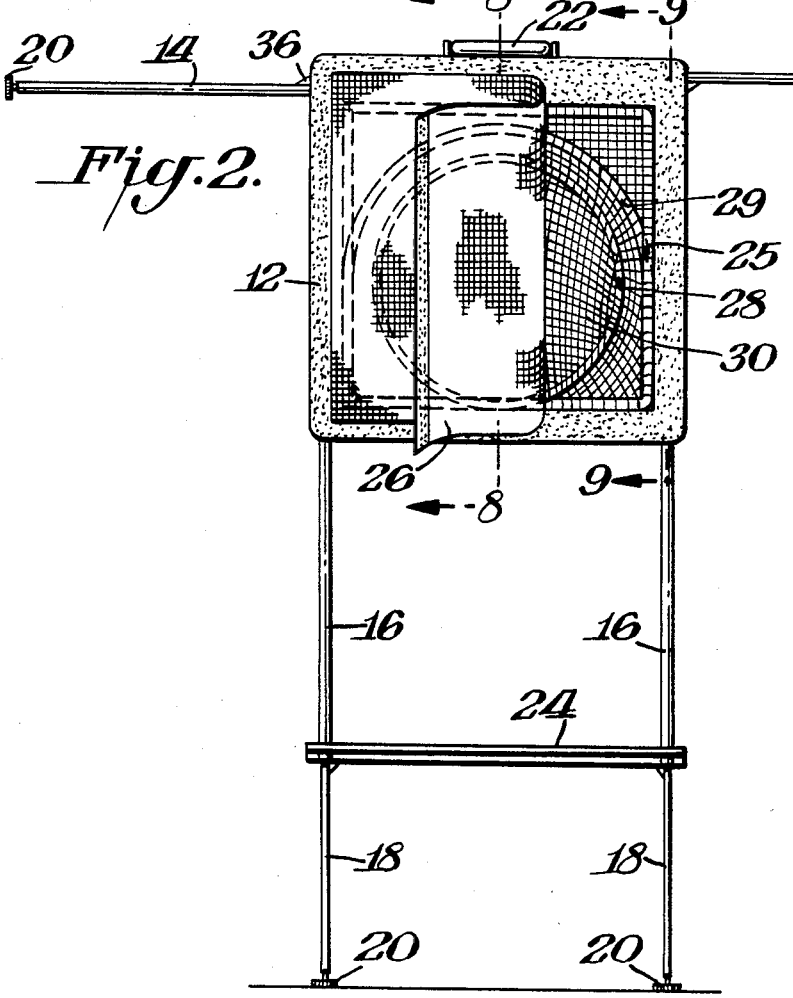
FIG. 2 is a front elevation of the fire escape apparatus set up and just prior to deploying the escape chute.

FIGS. 2–4 show the apparatus of the invention partly unfolded. In FIG. 2 the elements of the assembly 10 are shown, including the outer casing 12, generally rectangular, having a top and bottom and two sides, substantially in the shape of a suitcase. This frame can be molded or cast from various plastic materials. Extending outwardly, horizontally, from casing 12 are arms 14. Extending downwardly from casing 12 are telescoping leg members comprising the first stage of the telescoping leg 18 and the second stage 16. At the ends of arm members 14 and leg members 18 are finger grips 20 which enable a user to grasp these grips and pull the arm and leg members to the desired extension. Handle 22 provides means for carrying the assembly. A step 24 is preferably provided to assist the user in entering the escape opening.

The front flap 26, which may be of a suitable fabric and have Velcro® or other closure means, is shown partly open in FIG. 2, and the fire escape chute apparatus is shown folded up in casing 12. This apparatus comprises a first, generally rectangular support ring 25, securely mounted in frame 12. Connected to this first support member is one end of mesh tube 30, the other end of which is connected to the second ring support member 28, the support members and rings being as disclosed in my prior U.S. Pat. No. 4,398,621. Semi-circular bar 29 is pivotally connected to casing 12 and is intertwined among the meshes in tube 30 such that, when the tube is deployed, this bar is at an angle of approximately 45° to the vertical, providing a readily accessible entrance to the escape chute. This is more clearly seen in FIGS. 5 and 10.

FIGS. 3 and 4 show top plan and side elevational views, respectively, of the assembly of FIG. 2, including casing 12, arms 14, telescoping leg members 16 and 18, finger tip grips 20, handle 22, step 24, first support ring 25, front flap 26, second support ring 28, pivotal, and semi-circular bar 29 attached to casing 12 by pivotal hinge 31. The mesh tube 30 is not included in these figures for clarity. Finger groove 34 is preferably provided to assist the user in exiting through the first support ring member 25. Rear closure flap 27 is shown in the closed position. This flap is hinged along the bottom of frame casing 12 such that, when opened, this flap extends outwardly through the opening of the building.

Figure 5:
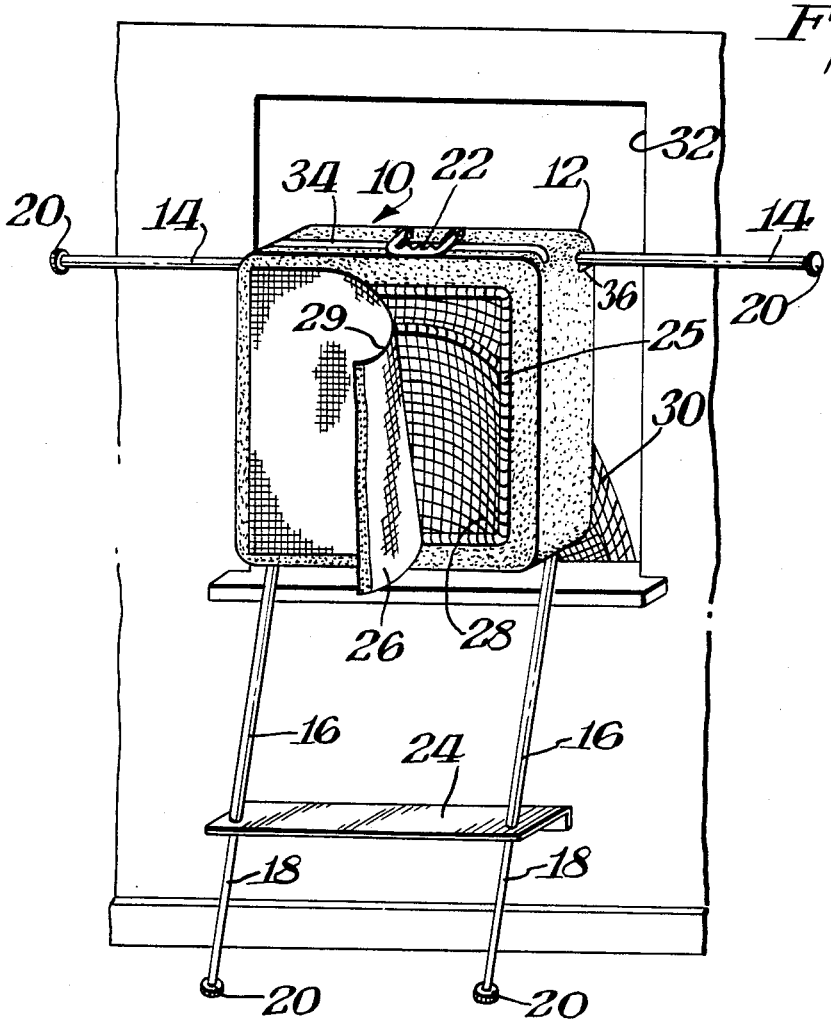
FIG. 5 is a pictorial view of the apparatus of the invention set up adjacent a window of a building with the fire escape chute deployed out of the window.

FIG. 5 is a pictorial view from the inside of the building from which the fire escape apparatus of this invention is fully deployed. Casing 12 having extended arm members 14 and extended leg members 16 and 18 is shown adjacent window opening 32. Rear closure flap 27 has been opened and extends outwardly through the window across its sill. Front closure flap 26 is open and mesh tube 30 and the second support ring 28 have been deployed downwardly. Semi-circular bar 29 has pivoted to an angle of approximately 45° to the vertical, providing an entry opening as shown. Finger grips 20, handle 22, step 24 and finger groove 34 are shown for completeness. In this configuration, the apparatus of the invention is ready for escape.

Figure 6:
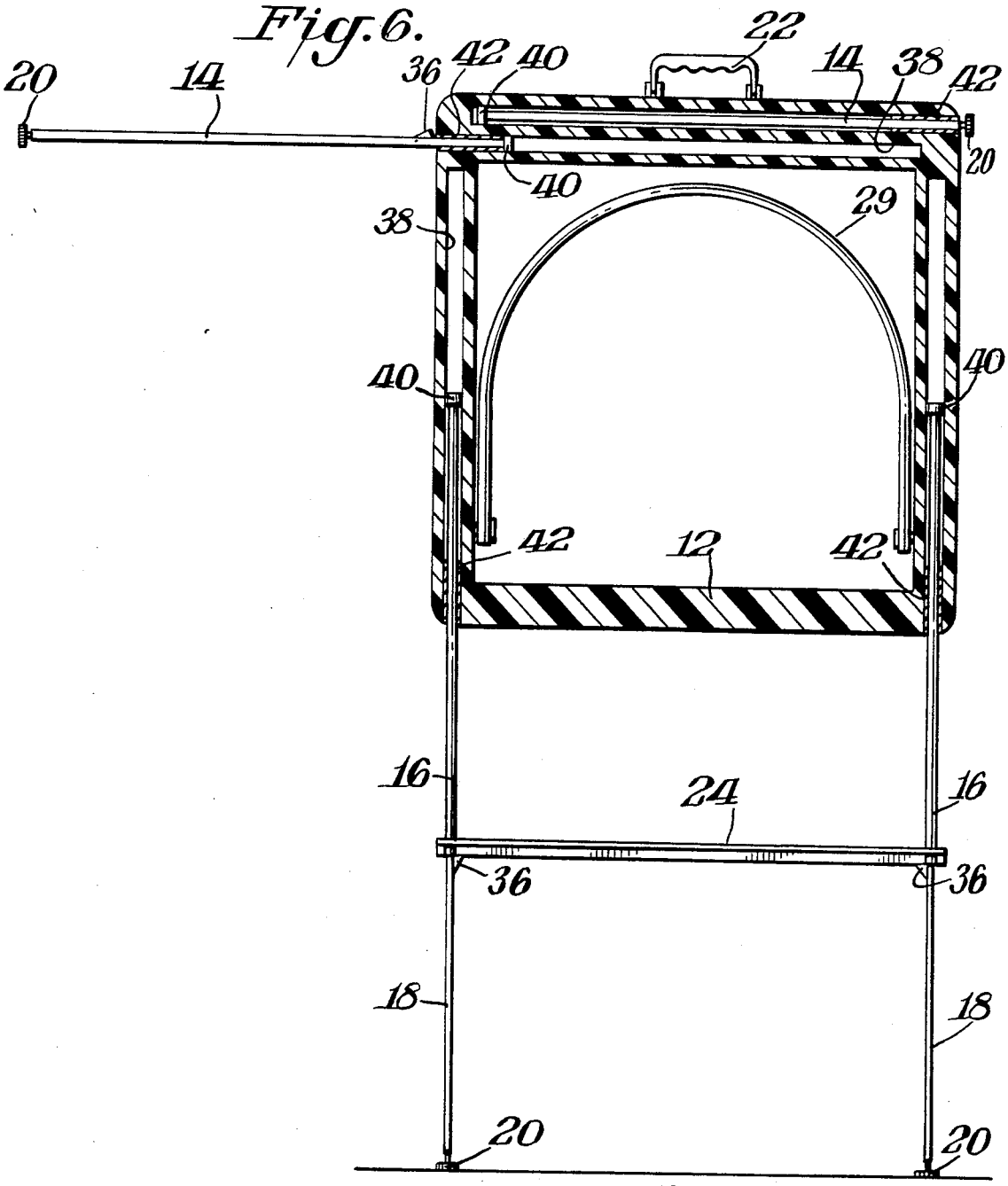
FIG. 6 is a cross-sectional view of the apparatus of the invention taken substantially along line 6—6 of FIG. 4.

FIG. 6 is a cross-sectional view take substantially along line 6—6 of FIG. 4, and shows in detail the recesses 38 which house the arm and telescoping leg members 14, 16 and 18. These elongate recesses 38 may be cast or drilled into casing 12. The horizontal recesses 38 which house arm members 14 are preferably oriented one above the other so that there is no cocking or twisting of the assembly when put to use. Each arm member 14 and leg member 16 has a stop 40 attached to its innermost end as shown and each receptacle 38 has sleeve 42 affixed to frame 12 near its opening, also as shown. These stops and sleeves provide further support and prevent the arms and legs from coming out of the recesses 38 in casing 12. Also shown in FIG. 6 are spring-loaded stops 36 which provide a mechanism for locking arms 14 and leg members 16 and 18 in their fully extended configuration.

Figure 7:
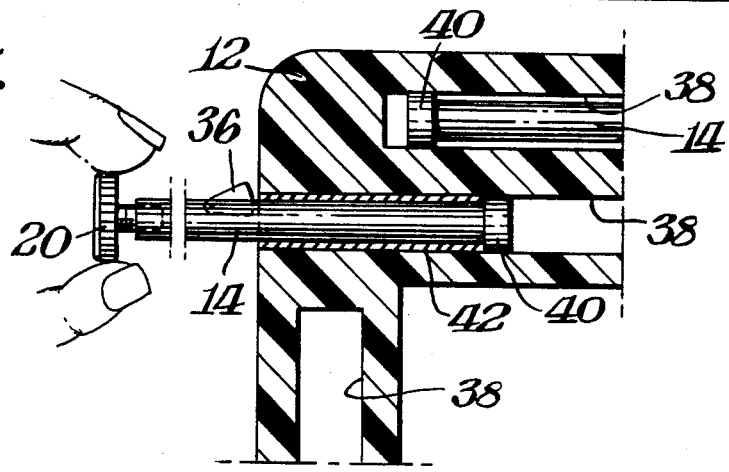
FIG. 7 is an exploded view, partly in cross-section, of an outwardly extendable arm member of the device of the invention and showing its recesses within the frame member of the carrying case for the escape chute.

FIG. 7 shows an exploded view of one of the arms 14 extending from a recess 38 in casing 12. The arm 14 is shown being pulled from recess 38 by means of finger grip 20. Stop 40 prohibits the arm from coming out of recess 38 when it hits sleeve 42. Spring-loaded snap lock 36 holds arm member 14 securely in its fully extended position.

Figure 8:
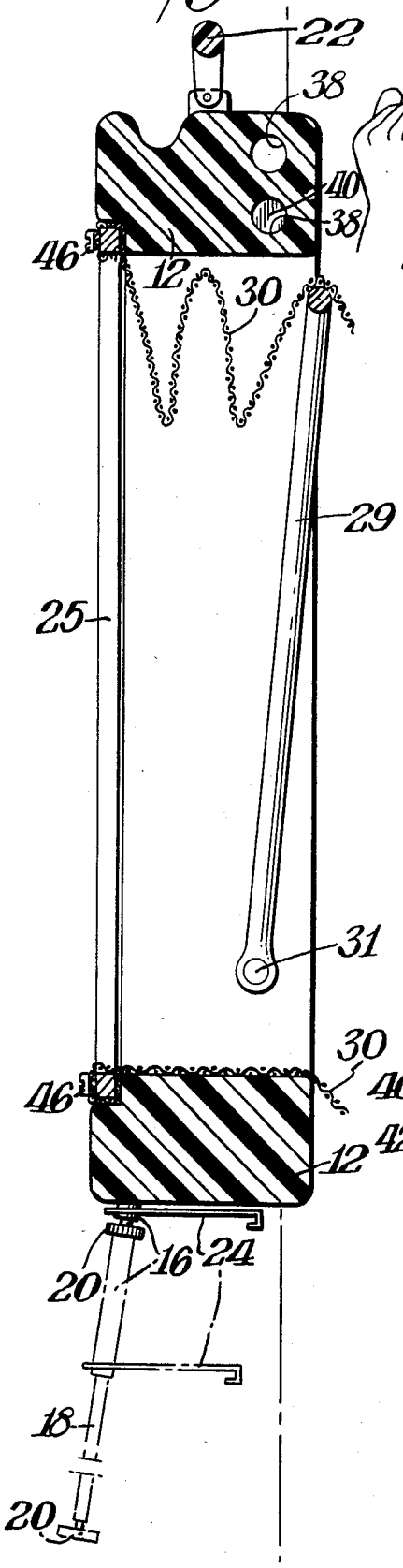
FIG. 8 is a cross-sectional view, taken substantially along line 8—8 of FIG. 2.

FIG. 8 is a cross-sectional view taken along line 8—8 of FIG. 2, after the mesh tube 30 and second support ring 28 have been deployed. The first rectangular support ring 25, to which mesh tube is attached, is secured to frame 12 by fastening means 46. Semi-circular spacer bar 29 is pivotally affixed to frame 12 by pivotal hinge 31. The telescoping leg members and step 24 are shown in their closed position and, in phantom, in their open position. The hand of a person about to enter is shown grasping finger groove 34.

Figure 9:
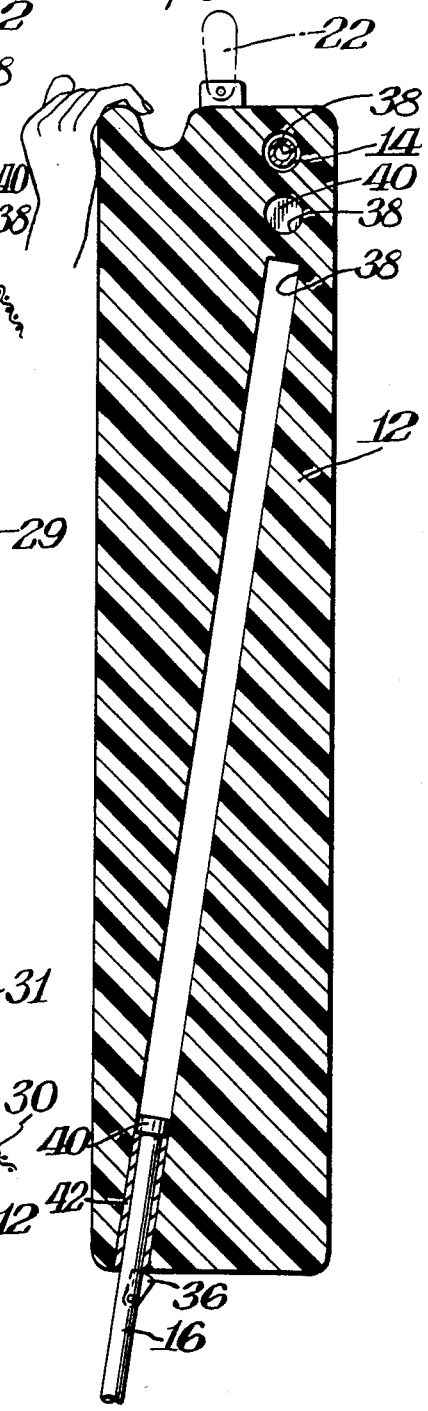
FIG. 9 is a cross-sectional view taken along line 9—9 of FIG. 2.

FIG. 9 shows a cross-sectional view of the assembly taken along line 9—9 of FIG. 2. The vertical recesses 38 are preferably inclined somewhat from the vertical as shown in order to provide more stability in use. Stop 40 resting on sleeve 42 prevents leg member 16 from exiting recess 38, and the leg member is held in place by spring-loaded snap lock 36.

Figure 10:
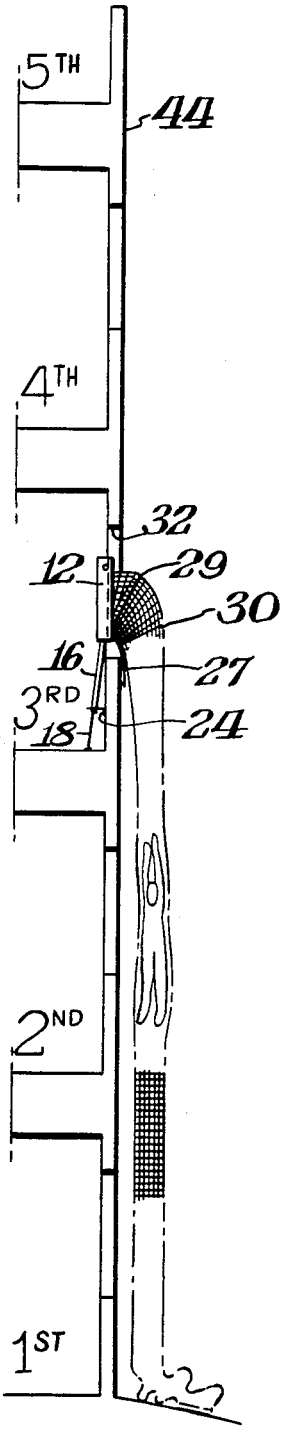
FIG. 10 is a pictorial view showing a person escaping from the third floor of a building using the apparatus of the invention.

FIG. 10 shows a person exiting from the third floor of a building 44. The mesh in tube 30 is such that individual openings in the mesh are large enough to enable a user to grip the cords of the mesh with his fingers but are small enough to prevent the user's feet from passing through. Thus, the user can control his rate of descent with his hands by gripping the cords of mesh tube 30.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. Fire escape apparatus for exiting a building through an opening in said building, the apparatus comprising a first, supporting entry ring member and a mesh tube attached at one of its ends to said first supporting entry member, said mesh tube being substantially longer than the building height from which escape is necessary, and a second, exit-opening support ring member attached to the other end of said mesh tube, said first supporting member being substantially a rectangular ring affixed within a generally rectangular frame casing having a top, a bottom and two sides, said casing being generally in the shape of a suitcase, said top having a handle affixed thereto, said top of said frame having at least two horizontal elongate recesses therein, in which horizontal recesses are housed extensible, elongate arm-like members, said sides of said frame each having at least one generally vertical elongate recess therein, in which vertical recesses are housed extensible, elongate leg-like members said frame having front and rear closure flaps and closure means which enable closure of and encasement within said frame of said first supporting member, said attached mesh tube in a folded condition and said second, exit-opening support ring member, thereby, when closed, there is provided compact and portable fire escape means, whereby, when needed, a user places said apparatus adjacent an opening such as a window of a building from which escape is necessary, extends said arm-like and leg-like members, the former to their fully-extended length and the latter to a desired length to accomodate the height of said window, places the rear of said frame adjacent said window and opens said rear flap, allowing it to extend outwardly from said window, and then opens said front flap and deploys said second support member and mesh tube outwardly and downwardly through said window, providing said user means for escaping said building through said mesh tube.

2. The apparatus of claim 1 wherein said leg members are telescoping elongate members having spring-loaded snap locks to lock them in place at a desired extension.

3. The apparatus of claim 1 having a step means extending from one leg-like member to another leg-like member.

4. The apparatus of claim 1 having a generally semi-circular spacer bar pivotally attached to each said side of said frame and intertwined among the meshes of said mesh tube in such orientation that upon deployment of said tube said spacer bar is oriented at approximately 45° to the vertical, thereby providing an easily accessible entrance opening for said user.

5. The apparatus of claim 1 wherein the openings in said mesh tube are large enough to permit finger insertion therein but small enough to prevent foot insertion therethrough.

6. The apparatus of claim 1 wherein the openings in said mesh tube have a maximum dimension of about two inches.

7. The apparatus of claim 1 wherein said tube has inside diameter sufficiently large so as not to restrict passage of a person escaping therethrough, whereby said escaping person can control his rate of descent by grasping the mesh anywhere within the tube.

8. The apparatus of claim 1 wherein said mesh tube has an inside diameter in the range of about 3 feet to about 4 feet.

9. The apparatus of claim 1 having an opaque shield encircling at least a part of the upper portion of said tube thereof so as to prevent a person using the escape from seeing through said mesh upon entry into the escape.

10. The apparatus of claim 1 wherein said mesh tube is made of fire resistant nylon cord.

11. The apparatus of claim 1 wherein said mesh tube is made of fire resistant, elastic bungi cord.

12. The apparatus of claim 1 wherein said top of said frame has a groove extending from one side to the other to enable finger insertion therein to assist said user in entering said escape.

* * * * *